United States Patent [19]

Itano

[11] Patent Number: 4,466,507

[45] Date of Patent: Aug. 21, 1984

[54] EMERGENCY ESCAPE APPARATUS

[76] Inventor: Frank Itano, 203 Clinton St., Yuba City, Calif. 95991

[21] Appl. No.: 504,952

[22] Filed: Jun. 16, 1983

[51] Int. Cl.[3] ..... A62B 1/00

[52] U.S. Cl. ..... 182/3; 182/43; 182/82

[58] Field of Search ..... 182/3, 4, 5, 6, 7, 42, 182/43, 44, 82

[56] References Cited

U.S. PATENT DOCUMENTS

| | | | |
|---|---|---|---|
| 204,581 | 6/1878 | Knight et al. | 182/43 |
| 292,322 | 1/1884 | Knauer | 182/43 |
| 498,997 | 6/1893 | Venema | 182/43 |
| 748,114 | 12/1903 | Smith | 182/43 |
| 861,707 | 7/1907 | Cain | 182/42 |
| 892,281 | 6/1908 | Metter | 182/42 |
| 2,963,178 | 12/1960 | Walker | 182/42 |
| 3,831,711 | 8/1974 | Smith | 182/42 |
| 3,944,021 | 3/1976 | Smith | 182/3 |
| 4,125,172 | 11/1978 | Hatala | 182/82 |

*Primary Examiner*—Reinaldo P. Machado
*Attorney, Agent, or Firm*—Mikio Ishimaru

[57] ABSTRACT

A fire escape having a roller chain carried in a slotted vertically extending tube and driven to cause controlled downwardly movement in the tube. The roller chain carries ears which support molded plastic balls connected through the tube's slot to harnesses for escaping persons. The controlled movement of the chain allows even an unconscious person to be lowered from the top of a building safely to the ground.

23 Claims, 8 Drawing Figures

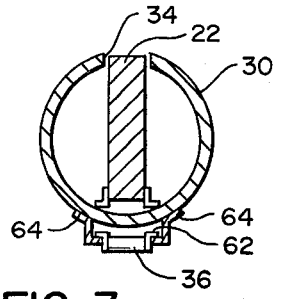
FIG. 3
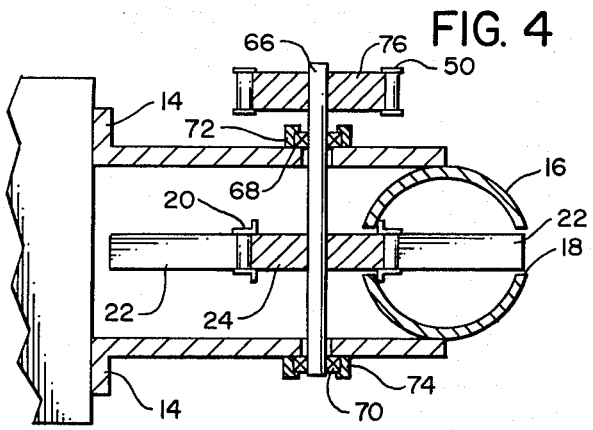
FIG. 4
FIG. 5
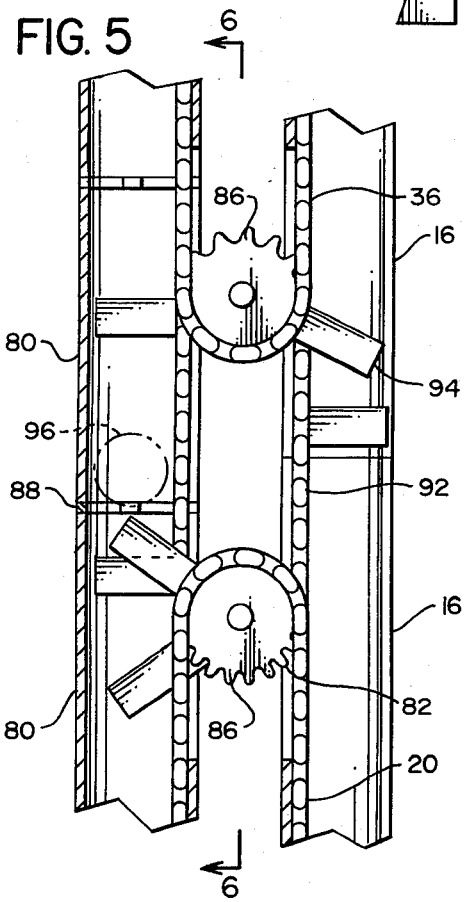
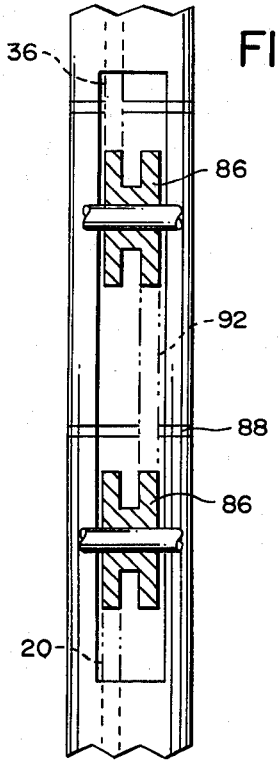
FIG. 6
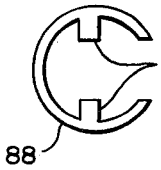
FIG. 7
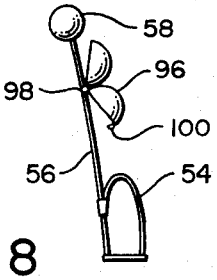
FIG. 8

EMERGENCY ESCAPE APPARATUS

BACKGROUND OF THE INVENTION

The present invention relates generally to emergency escape apparatus for a building and more particularly to a motorized fire escape for high rise buildings.

In the past, there have been many deaths due to a lack of simple, effective fire escape system from tall high rise buildings such as hotels and modern apartment buildings. In case of fire, the occupants of these buildings are told to try to stay in their rooms or try to take the stairways down to the ground because while access to the roof might be easy there are no convenient ways of bringing people down from a highrise roof.

Various expedients have been used to rescue people from burning buildings. For the lower buildings, a safety net is sufficient or a ladder from a fire truck. However, for very tall buildings, the only rescue system available has been the limited carrying capability helicopters which in many instances were totally useless due to adverse weather conditions.

Another form of fire escape apparatus has used a rope with a means for allowing the person to brake himself while going down the rope. The disadvantage of this system is that there is no way for a person who is unconscious due to smoke inhalation to be lowered and some knowledge of mountaineering is required. Another disadvantage of this system is that once an occupant has reached the ground there is no way for returning the braking mechanism back to the roof for re-use.

SUMMARY OF INVENTION

The present invention provides fire escape apparatus which may even be used by an unconscious person.

The present invention further provides a system which may be easily expanded for multi-story buildings with no limitation as to the maximum height of the building.

The present invention further provides an inexpensive motorized fire escape.

The present invention further provides mechanism by which the operative part of the fire escape apparatus may be returned to the roof of the multi-purpose building for re-use.

Other advantages of the present invention will be apparent to those skilled in the art from a review of the following drawings and the description of the preferred embodiments.

BRIEF DESCRIPTION OF THE DRAWINGS

FIG. 3 is a cross-sectional view of the present invention taken along line 3—3 of FIG. 1;

FIG. 4 is a cross sectional view of the present invention taken along line 4—4 of FIG. 1;

FIG. 5 is a cross-sectional view of an alternate embodiment of the present invention taken along the line 5—5 of FIG. 6;

FIG. 6 is a front view of the alternate embodiment of the present invention;

FIG. 7 is a top view of a portion of the alternate embodiment; and

FIG. 8 is a side view of an operative portion of the alternate embodiment.

DESCRIPTION OF THE PREFERRED EMBODIMENTS

Figure 1:
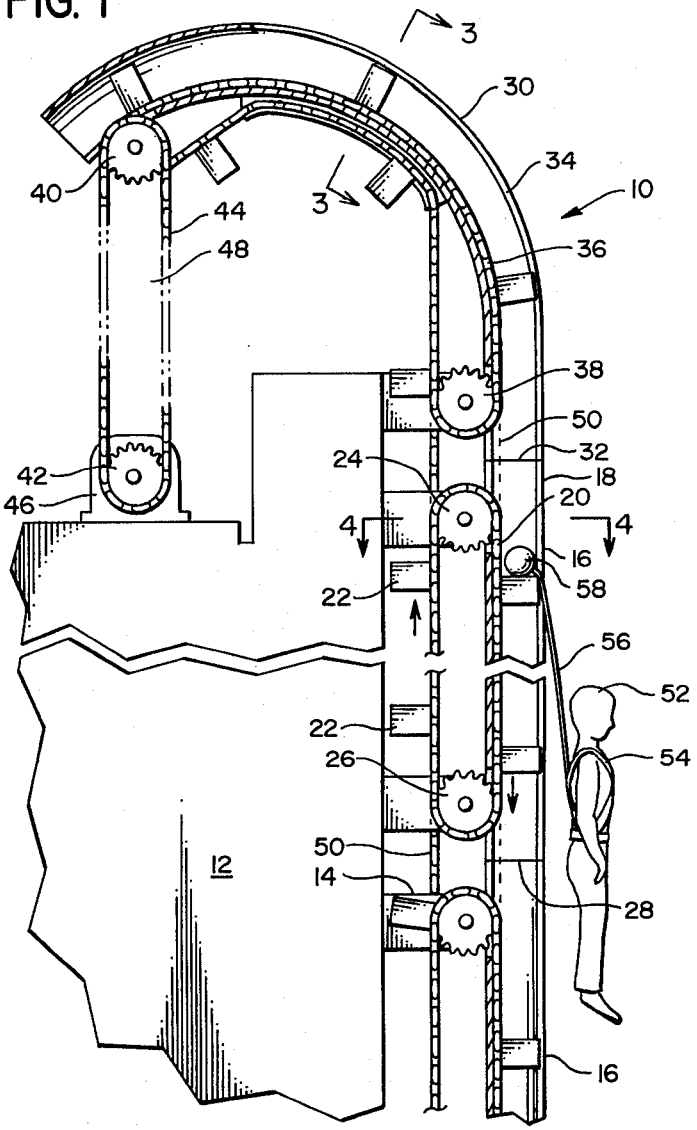
FIG. 1 is the side view of the present invention taken along the line 1—1 of FIG. 2.

Referring now to FIG. 1, therein is shown a cross-sectional view of the emergency escape apparatus 10 of the present invention. The building structure 12 has secured to it a plurality of support brackets 14.

The support brackets 14 are generally welded to a hollow member or tube 16. The tube 16 is open at both ends and is generally one story long for convenience although either shorter or longer lengths are possible. On the side of the tube away from the building there is provided a split 18 which runs the entire length of the tube 16. Disposed within the tube 16 is a plastic self-lubricated bushing, roller chain 20. As would be evident to those skilled in the art a plastic chain capable of supporting the necessary loads or a wire rope would be equally usable.

The chain 20 has secured thereon equi-distantly spaced, a plurality of ears 22 which are used to engage a member which will be described later. The chain 20 is driven by upper and lower sprockets 24 and 26, respectively, which may either be secured to the tube 16 or to the support brackets 14 for rotation therein. At the bottom portion of the tube 16, the open end is joined at joint 28 to another tube 16. At ground level for the building 12, the bottom-most tube 16 will be spaced a short distance above the ground.

At the top end of the tube 16, the open end is connected to an arcuate tube 30 at a joint 32. As would be evident to those skilled in the art, the joint 32 may be achieved merely by lining up the tubes, by welding, or by bolting a collar over the nonsplit portion.

The ears 22 extend into the split on tube 16. The ears 22 use the split as a guide.

The arcuate tube 30 is similar to the tube 16 in having a split 34 provided in the building distal wall. The arcuate tube 30 has disposed therein a chain 36 having ears 22 secured thereto.

The chain 36 is driven by a pair of sprockets 38 and 40. The sprocket 40 is driven by another sprocket (not shown in FIG. 1) which is connected to a sprocket 42 by a drive chain 44. The sprocket 42 is driven by a gear reducer equipped motor 46 which is secured to the building 12. A support bracket 48 supports the portion of the arcuate tube 30 which extends over building 12.

The drive from the motor 46 is transferred via the drive chain 44 to the chain 36 which in turn drives a sprocket arrangement on which an intermediate drive chain 50 is disposed. This intermediate drive chain 50 further drives the sprocket 24 and the chain 20. Similarly, between stories of the building 12 are other intermediate drive chains 50 which drive the other chains for each story. As would be evident, while at one point the motor 46 will be driving, at other points the drive will be acting via the speed reducer as an electronic brake while lowering many occupants.

Figure 2:
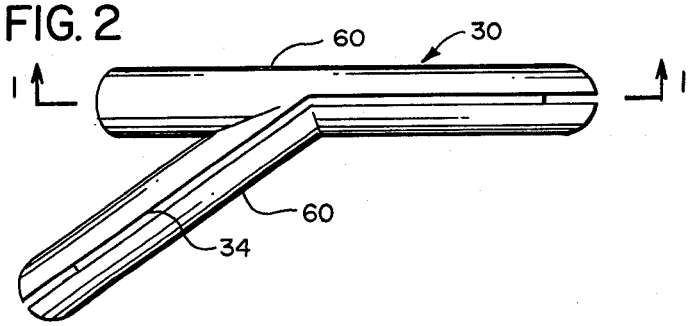
FIG. 2 is a top view of the present invention.

Also shown in FIG. 1 is the emergency escape apparatus in use with an occupant 52 being supported by a harness 54 which is connected by a wire 56 to a plastic ball 58 disposed within the tube 16. Referring now to FIG. 2, therein is shown a top view of the arcuate tube 30. The tube 30 is generally Y-shaped with a branch 60 welded thereon. The split 34 extends down this branch. FIG. 1 is the section taken along the line 1—1 of this figure.

Referring now to FIG. 3, therein is shown a cross section of FIG. 1 taken along the line 3—3. FIG. 3 shows the ear 22 as a rectangular member. It should be noted that the ear 22 only takes up a portion of the tube since the ball 58 is being utilized as the member engaging with the ear 22. If a cylindrical member were to replace the ball 58, the tube 30 and the tube 16 could be made rectangular to match the cross section of such an engageable means.

Because the chain 36 must clear safety walls which are sometimes on the edge of building roofs, it is desirable that the chain conform to the arc of the underside of the tube 30. In order to accomplish this, each of the links of the chain 36 are provided with a pair of wings 62 which engage a pair of flanges 64 on the underside of the arcuate tube 30.

Referring now to FIG. 4, therein is shown a cross sectional view of one of the bracket areas showing the bracket 14 which may be angle irons bolted to the side of the building 12. The sprocket 24 is secured to a shaft 66 which is mounted in a pair of bearings 68 and 70 which are respectively secured to the support brackets 14 by bearing plates 72 and 74. Outwardly of the bearings 68 and 70 is an intermediate sprocket 76 to which the intermediate chains 50 are connected.

As would be evident to those skilled in the art, from the particular drive arrangement shown it is evident that the motor 46 may be located either at the top or bottom of the building. In the preferred embodiment the motor 46 is placed at the top of the building 12 where it will not be easily accessible to vandals and its drive capabilities are the most important. To avoid problems with power failure to the building, in the preferred embodiment, the power lines (not shown) to the motor 46 run from ground level and are secured to the outside of the tubes.

In operation during an emergency, the occupants of the building will be advised to escape either upwards or downwards. At the roof, an occupant 52 will be placed in a harness 54. The ball 58 will be inserted in the split 34 of the branch 60 to be moved into engagement with one of the ears 22 on the chain 36. Generally, the ears on the chain 36 are closer together than on the chain 20 and the drive sprockets slightly smaller to more slowly pick up the occupant 52. The branch 60 permits cuing of people to use the emergency escape apparatus 10.

When a ball 58 reaches the straight portion of arcuate tube 30 it will be picked up to lift the occupant 52 over any wall on the building 12. Once past the wall, the occupant 52 will drop a short distance of about 3 feet under the influence of gravity to an ear 22 on the chain 20 which is timed to be at the highest position for engagement when the ball 58 disengages from the ear 22 on the chain 36.

Once the occupant 52 is being supported by an ear 22 on the chain 20, the motor 46 becomes an electric brake and slowly lowers the occupant from one tube 16 to the other tube 16 until the occupant is brought down to the ground. At the bottom the ball drops out at the open end of the tube and the occupant 52 may either walk or be carried away.

As would be evident, a large number of people may be using the emergency escape apparatus 10 at any one time to escape from burning building.

Returning now to FIG. 5, therein is shown an alternate embodiment of the present invention which includes tubes for returning the ball 58 in the harness 54 back to the roof of the building 12 so as to allow re-use thereof. Generally, the return tubes parallel the lowering tubes and are positioned closer to the building 12 so as to make use of the upward movement of the chain. As shown in FIG. 5, upper and lower tubes 16 are paralleled by return tubes designated by the numeral 80. The return tubes 80 may be supported by the support brackets 14 which in this embodiment support the double sprockets 82 and 86 which may best be seen by reference to FIG. 6. Disposed between the returned tubes 80 is a holder designated by the numeral 88 which may best be seen by reference to FIG. 7. Generally, the holder 88 will be made from elastomer material which is deformable to allow ears 90 on the interior portion of the holder 88 to deform to let an object pass through the center of said holder.

As seen in FIG. 5, the double sprockets 82 and 86 are connected by an intermediate drive chain 92 which carries on it a plurality of ears 94 which are equi-distantly spaced on the intermediate drive chain 92.

Referring now to FIG. 8 therein is shown a ball 58 connected by a wire 56 to a harness 54. Connected to the wire 56 between the ball 58 and the harness 54 is a ball-shaped container 96 which is hinged at the connection to the wire 56 at the hinge 98. The two halves of the ball-shaped container are oversized to allow the ball 58 and the harness 54 and wire 56 to be rolled up and contained by the container 96 which will be held closed by a latch 100 integrally molded therein. When in its closed condition, the container 96 is of a ball-shaped configuration which fits within the inside diameter of the return tube 80.

In operation, an occupant 52 will be lowered by means of the tube 16 down to the ground at which point the occupant 52 will remove the harness 54 and roll the ball 58, the wire 56 and the harness 54 into configuration fit within the ball-shaped container 96. The two halves of the container 96 will then be closed and held in place by the latch 100.

The container 96 will then be inserted in the bottom of return tube 80 where, as the emergency escape apparatus continues to operate, an ear 22 will engage the container 96 and move it upwardly in the return tube 80. The container 96 will continue to be urged upwardly by the ear 22 until it is pushed past the holder 88 by deforming the ears 90. Once the container 96 is past the holder 88, the ears 90 will spring back in place and retain the container 96 until an ear 94 on the intermediate drive chain 92 can engage the container 96 and continue to move it upward into engagement with another holder 88 which will again hold the ball until another ear 22 on the higher chain 20 can engage the container 96 and carry it to the roof of the building structure 12 where it can be removed. The container 96 will be opened to allow the ball 58 to be inserted back in cue and to be reused again.

As would be evident to those skilled in the art, it would be possible to use the double sprocket arranged shown in FIG. 5 in the arrangement shown in FIG. 1. However, this would mean that the precise spacing between the ears would become more critical, and the emergency escape apparatus would have to be tailored to each building taking into account the differences in distance between the various floors at all levels of the building. It should also be noted that the exact ear arrangement used with the double sprocket arrangement shown in FIG. 5 will require precise location in order to prevent jamming of the ball-shaped containers 96 and the ball 58 in their various movements in the emergency escape apparatus 10.

As many alternate embodiments would be evident to those skilled in the art from the foregoing description, the description should be construed in an illustrative and not a limiting sense.

I claim:

1. For a structure, emergency escape apparatus used with an occupant harness, comprising:

at least one vertically extending hollow member having a top and bottom, said hollow member having a vertically extending opening provided therein;

mounting means for securing said hollow member to said structure;

engagement means disposed in said hollow member and vertically movable therein, said engagement means engageable and disengageable respectively with said occupant harness at said top and bottom of said hollow member, said occupant harness extendable from said engagement means through said opening to said harness;

mover means at least partially disposed in said hollow member having said engagement means connected thereto to move said engagement means in said hollow member; and driver means connected to said mover means to control the speed of movement of said movement means and said engagement means in said hollow member.

2. The emergency escape apparatus, as claimed in claim 1 including:

at least one vertically extending hollow return member having a top and bottom;

mounting means for securing said return member to said structure;

said engagement means disposed in said return member and vertically movable therein, said engagement means engageable and disengageable respectively with said occupant harness at said bottom and top of said return member; and said mover means at least partially disposed in said return member having said engagement means connected thereto to move said occupant harness vertically upward in said return member.

3. The emergency escape apparatus as claimed in claim 1 including:

at least one horizontally extending hollow member having one end joined to said vertically extending hollow member and a horizontally extending opening providing therein;

mounting means for securing said horizontally extending hollow member to said structure;

second engagement means disposed in said horizontally extending hollow member and horizontally movable therein, said second engagement means engageable and disengageable respectively with said occupant harness at the end of said horizontally extending hollow member opposite said one end and said end, said occupant harness extendable from said engagement means through said horizontally extending opening and movable to engage said engagement means in said at least one vertically extending hollow member;

second mover means at least partially disposed in said horizontally extending hollow member to move said second engagement means therein; and second driver means connected to said second mover means.

4. The emergency escape apparatus as claimed in claim 3 including:

at least one horizontally extending hollow return member having one end proximate to said vertically extending hollow member;

mounting means for securing said horizontally extending hollow return member to said structure;

said second engagement means disposed in said horizontally extending hollow return member and horizontally movable therein, said second engagement means engageable and disengageable respectively with said occupant harness at ends proximal and distal from said horizontally extending hollow return member;

said second mover means at least partially disposed in said horizontally extending hollow return member to move said second engagement means therein.

5. The emergency escape apparatus as claimed in claim 1 including:

a further vertically extending hollow member having top and a bottom, said further vertically extending hollow member having a vertically extending opening provided therein, said further vertically extending hollow member operatively connected at said top to said bottom of said at least one vertically extending hollow member;

mounting means for securing said second vertically extending hollow member to said structure;

further engagement means disposed in said further vertically extending hollow member and movable therein, said further engagement means engageable and disengageable respectively with said occupant harness at said top and said bottom of said further vertically extending hollow member, said occupant harness extendable from said further engagement means through said opening to said harness;

further mover means at least partially disposed in said further vertically extending hollow member having said further engagement means connected thereto to move said further engagement means in said further vertically extending hollow member; and further driver means connected to said further mover means to control the speed of movement of said further mover means of said further engagement means in said further vertically extending hollow member.

6. The emergency escape apparatus as claimed in claim 5 including:

a further vertically extending hollow return member having top and a bottom, said further vertically extending hollow return member parallel to and proximate said at least one vertically extending hollow return member;

mounting means for securing said further vertically extending hollow return member to said structure;

said further engagement means disposed in said further vertically extending hollow member and movable therein, said further engagement means engageable and disengageable respectively with said occupant harness at said bottom and said top of said further vertically extending hollow return member; and said further mover means at least partially disposed in said further vertically extending hollow return member having said further engagement means connected thereto to move said further engagement means in said further vertically extending hollow return member.

7. For a building, emergency escape apparatus used with an occupant harness having an engageable member connected thereto, comprising;

a vertical tube open at the top and bottom, said tube having a vertical slit extending from top to bottom, mounting means for supporting said vertical tube on said building;

engagement means disposed in said vertical tube and downwardly movable therein, said engagement means engageable with said engageable member at the top thereof and downwardly movable therewith to disengage with said engageable member at the bottom of said vertical tube, said engageable member extendable from said vertical tube through said vertical slit;

chain means disposed inside and outside said vertical tube, said chain means having engagement means connected thereto to move said engagement means downwardly in said vertical tube; and driver means connected to said chain means to control the downward movement of said chain means and said engagement means in said vertical tube.

8. The emergency escape apparatus, used with a container for the occupant harnes, as claimed in claim 7 including:

a vertical return tube open at the top and bottom;

mounting means for supporting said vertical return tube parallel to said vertical tube;

said engagement means disposed in said vertical return tube and upwardly movable therein, said engagement means engageable with the carrier at the bottom thereof and upwardly movable therewith to disengage with said engageable member at the top of said vertical tube and;

said chain means disposed inside said vertical return tube, said chain means having engagement means connected thereto to move said container upwardly in said vertical return tube.

9. The emergency escape apparatus as claimed in claim 7 including:

an arcuate tube having a slit provided therein on the top thereof, said arcuate tube having one end joined to said vertical tube with said slits in line;

mounting means for supporting said arcuate tube above said building;

second engagement means disposed inside and outside said arcuate tube and movable therein to lift said engageable means a predetermined distance and allow said engageable means to drop a predetermined distance to said engagement means in said vertical tube with said engageable means extending from said slits to said harness;

second chain means disposed inside said arcuate tube to move said second engagement means therein; and chain driver means connected to drive said second chain means.

10. The emergency escape apparatus, used with a container for the occupant harness, as claimed in claim 9 including;

an arcuate return tube parallel to having ends proximate said vertical tube;

mounting means for supporting said arcuate return tube above said building;

said second engagement means disposed inside and outside said arcuate tube and movable therein to lift said container from said engagement means a predetermined distance and allow said container to drop a predetermined distance; and said second chain means disposed inside and outside said arcuate return tube to move said second engagement means therein.

11. The emergency escape apparatus as claimed in claim 7 including:

a further vertical tube open at the top and bottom, said further vertical tube having a further vertical slit provided therein, said further vertical tube connected at the top to said vertical tube;

mounting means for supporting said further vertical tube on said building;

further engagement means disposed inside and outside said further vertical tube and downwardly movable therein, said further engagement means engageable with said engageable member at the top of said vertical tube and disengageable at the bottom thereof, said engageable means extendable through said vertical slit to said harness;

further chain means disposed inside and outside said vertical tube having said further engagement means connected thereto to lower said further engagement means in said further vertical tube; and further driver means connected to said further chain means to control the speed of lowering said further engagement means in said further vertical tube.

12. The emergency escape apparatus as claimed in claim 11 including:

a further vertical return tube open at the top and bottom, said further vertical return tube parallel to and proximate said further vertical tube;

mounting means for supporting said further vertical return tube parallel to said further vertical tube;

said further engagement means disposed inside and outside said further vertical return tube and upwardly movable therein, said further engagement means engageable with said container at the bottom of said vertical return tube and disengageable at the top thereof; and said further chain means disposed inside and outside said vertical return tube having said further engagement means connected thereto to lift said further engagement means in said further vertical return tube.

13. The emergency escape apparatus as claimed in claim 11 including:

additional driver means connected to said further driver means; and additional chain means connected to said additional driver means to transfer drive between said tubes.

14. The emergency escape apparatus as claimed in claim 10 wherein said arcuate tube includes means having said slit provided therein for cuing said engageable means for engagement would said engagement means.

15. For a multi-story building, emergency escape apparatus used with an occupant harness connected by a wire to a ball, comprising:

a one story high vertical cylinder open to the top and bottom, said cylinder having a slit extending from said top to said bottom;

support brackets for holding said cylinder to said building;

a plurality of ears in said cylinder and downwardly movable therein, said plurality of ears supporting said ball from said top of said cylinder to said bottom with said wire extending through said slit to said occupant harness;

a roller chain disposed inside and outside said cylinder, said roller chain having said plurality of ears connected thereto in spaced apart relationship;

top and bottom sprockets mounted in said support brackets engaging said roller chain to move said roller chain in said cylinder; and electric motor operatively connected to said top sprocket to control the speed thereof.

16. The emergency escape apparatus, used with a ball-shaped container for the occupant harness and ball, as claimed in claim 15 including:

a one story high vertical return cylinder open to the top and bottom;

support brackets for holding said return cylinder parallel to said cylinder;

said plurality of ears in said return cylinder and upwardly movable therein, said plurality of ears supporting said container from said bottom of said cylinder to said top; and said roller chain disposed inside said cylinder and said return cylinder.

17. The emergency escape apparatus as claimed in claim 15 including:

an inverted U-shaped cylinder having one end joined to said vertical cylinder and a slit provided therein along the top thereof;

support brackets for supporting said U-shaped cylinder on said building;

a second plurality of ears in said U-shaped cylinder and movable therein, said second plurality of ears pulling said ball up one portion of said U and allowing said ball to slide down a second portion of said U to be supported by one of said plurality of ears in said vertical cylinder, said ball having said wire extending through said top slit to said harness;

a second roller chain disposed inside and outside said U-shaped cylinder, said roller chain having said second plurality of ears connected thereto in spaced apart relationship closer than on said roller chain;

first and second sprockets rotatable in said support brackets for causing said second roller chain to move said ball; and wherein said electric motor is operatively connected to drive said first sprocket.

18. The emergency escape apparatus, used with a ball-shaped container for the occupant harness and ball, as claimed in claim 17 including:

an inverted U-shaped return cylinder having one end joined to said vertical return cylinder at the top thereof;

support brackets for supporting said U-shaped return cylinder parallel to said U-shaped cylinder;

said second plurality of ears in said U-shaped return cylinder and movable therein, said second plurality of ears pulling said container up one portion of said U and allowing said ball to slide down a second portion of said U;

said second roller chain disposed inside and outside said U-shaped return cylinder.

19. The emergency escape apparatus as claimed in claim 18 including:

a further, one story high vertical cylinder connected at the top to said first vertical cylinder and open at the bottom to allow removal of said ball, said further cylinder having a vertical slit provided therein;

support brackets for holding said further cylinder to said building;

a further plurality of ears in said further cylinder and downwardly movable therein, said further plurality of ears receiving said ball at the top of said further cylinder and allowing removal of said ball at the bottom thereof, said ball supported by one of said plurality of ears with said wire extending through said vertical slit to said har- ness;

a further roller chain disposed inside and outside said further vertical cylinder, said further roller chain having said further plurality of ears connected thereto in spaced apart relationship;

first and second further sprockets supported by said further support brackets causing said further roller chain to allow said ball to be lowered; and wherein said electric motor is operatively connected to drive said first further sprocket.

20. The emergency escape apparatus, used with a ball-shaped container for the occupant harness and ball, as claimed in claim 19 including:

a further, one story high vertical return cylinder connected at the top to said first vertical return cylinder and open at the bottom to allow insertion of said container;

support brackets for holding said further return cylinder parallel to said further cylinder;

said further plurality of ears in said further return cylinder and upwardly movable therein, one of said further plurality of ears receiving said container at the bottom of said further return cylinder and allowing removal of said container at the top thereof.

21. The emergency escape apparatus as claimed in claim 17 including:

additional sprockets connected to said further sprockets; and additional roller chains connected to said additional sprockets to transfer drive between said cylinders.

22. The emergency escape apparatus as claimed in claim 21 wherein said U-shaped cylinder includes a branch having said slit provided therein for cuing said balls for engagement with said plurality for ears.

23. The emergency escape apparatus as claimed in claim 22 wherein said U-shaped cylinder includes means cooperative with said second roller chain to cause said second roller chain to move along the inside of the said U-shaped cylinder.

* * * * *